US005921331A

United States Patent [19]

Randall

[11] Patent Number: 5,921,331

[45] Date of Patent: Jul. 13, 1999

[54] BACKREAMER

[75] Inventor: Guy P. Randall, Wichita, Kans.

[73] Assignee: StraightLine Manufacturing, Inc., Newton, Kans.

[21] Appl. No.: 08/834,092

[22] Filed: Apr. 14, 1997

[51] Int. Cl.[6] ..... E21B 10/44

[52] U.S. Cl. ..... 175/394; 175/406

[58] Field of Search ..... 175/53, 345, 406, 175/393, 394

[56] References Cited

U.S. PATENT DOCUMENTS 5,687,807 11/1997 Woods et al. ..... 175/406 X

*Primary Examiner*—William Neuder
*Attorney, Agent, or Firm*—Edward L. Brown, Jr.

[57] ABSTRACT

A directional horizontal boring backreamer for enlarging an initial bore, including three equally spaced radially extending wings attach to a common axle, equally spaced around the axle, each wing including a plurality of cutters positioned along the wing for enlarging the bore, and attached to each wing is a gusset plate welded to the axle at the juncture of the wing and axle and to the wing for added bending strength to the wing. The gusset plates also including an internal passage way from the center passage of the axle to the outer edge of the wings to support and supply a series of fluid jets supplied by fluid for assistance in cutting during the backreaming operation.

8 Claims, 5 Drawing Sheets

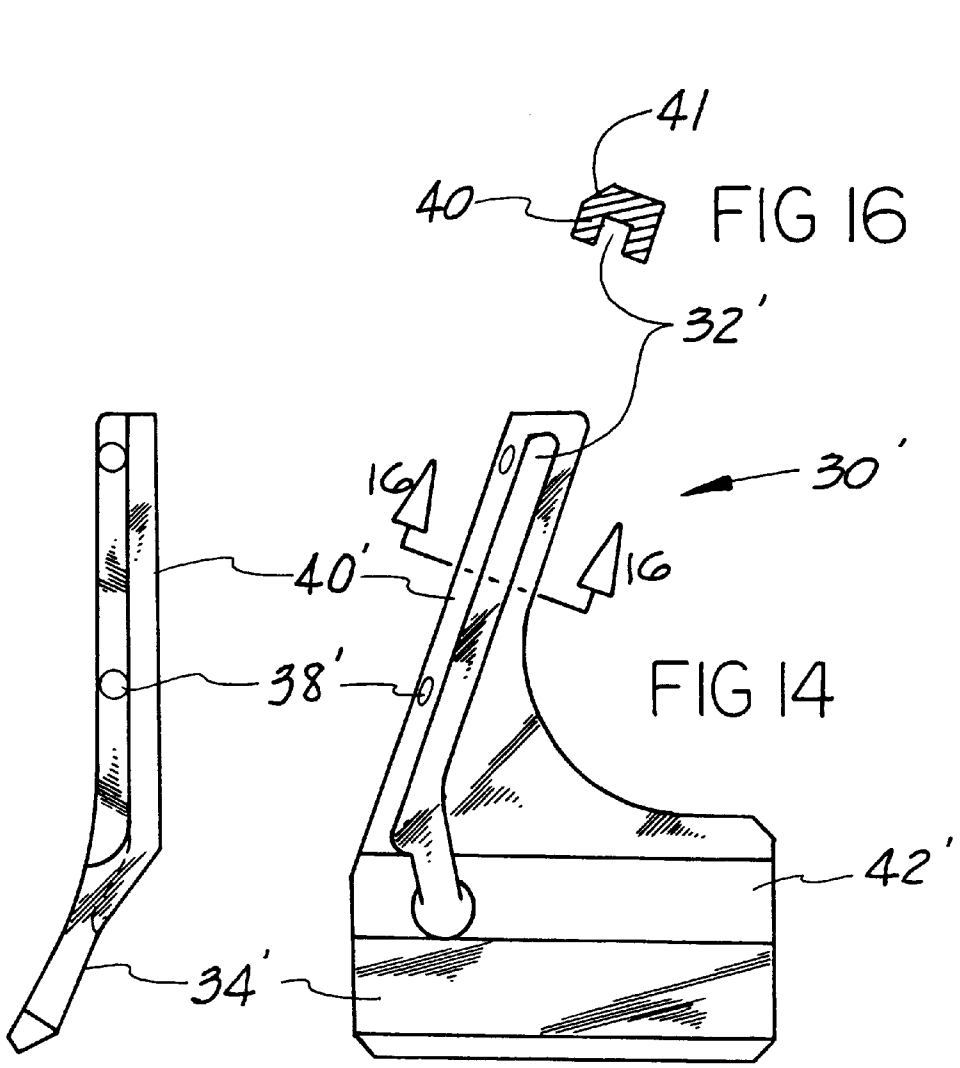
FIG 13
FIG 14
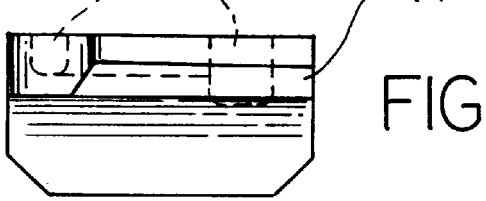
FIG 16
FIG 15
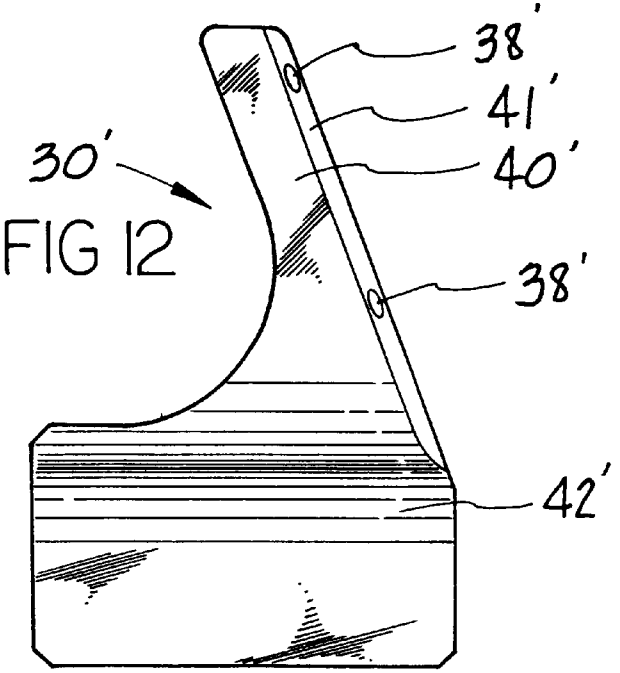
FIG 12

BACKREAMER

BACKGROUND OF THE INVENTION

The present invention relates to directional horizontal boring and more specifically to a backreamer design generally referred to as a winged cutter with fluid jets positioned outward on said cutter wings.

Backreamers in directional drilling have been available since the earliest developments of directional technology. A backreamer is a downhole tool that increases the diameter of a pilot bore hole. Usually on the pull-back phase of a directional drilling bore, the permanent casing or the utility lines are pulled behind the reamer through a swivel back through the enlarged bore hole. There are many different types of reamers utilized with various soil conditions, such as cones with teeth, spiral cutters, fluted cone backreamers, and winged backreamers.

Winged backreamers apply tremendous bending loads on the base of the wings due to their long moment arms, thereby applying substantial loads at the juncture point of the wings with the axle. A prior art method of dealing with these loads is to connect the outer ends of the reamer wings by a ring structure which transmits the bending loads on one wing to the remaining wings on the backreamer, thereby transferring or spreading the load. Backreamers with rings create additional drag and potential blockage problem which a cantilevered wing would not have. The load on the wings can also be diminished by lengthening the base portion of the wing where it is welded to the axle to increase the cross-sectional area of the welded joint between the wing and the axle of the backreamer.

SUMMARY OF THE PRESENT INVENTION

The backreamer design of the present invention teaches an alternate method of strengthening the wings of the backreamer by providing a gusset plate which is welded on the back or compression side of the wing to stiffen the wing and give it increased strength against bending as the backreamer rotates as its moving through the ground. This added gusset plate design also provides an additional function in that it includes a longitudinal passage through the gusset plate which connects drilling fluid from the center bore of the drill string to fluid jets which provides the drilling fluid for removal of cuttings and reducing friction. The gusset plate provides an open passage on one side thereof which connects with a bore in the axle and when the gusset plate is fully welded in place, provides a sealed passage from the center bore to the fluid jets which are drilled in the gusset plate at various radial locations outwardly toward the outer diameter of the backreamer. This provides drilling fluid from the backreamer's outer radius inward which assists in creating a slurry and removal of the cuttings created by the backreamer's cutters.

It is therefore the principal object of the present invention to provide a wing-type backreamer of various diameters which includes gusset plates on the wings for added strength and a fluid passage means for the drilling jets placed outwardly on the wings.

Another object of the present invention is to provide a wing cutter backreamer with less drag.

A still further object of the present invention is to provide a winged cutter backreamer with fluid jets spaced outwardly at different radii on the wings.

BRIEF DESCRIPTION OF THE DRAWINGS

FIG. 12 is a plan view of a large gusset plate;

FIG. 13 is a right side elevational view of the gusset plate of FIG. 12;

FIG. 14 is a bottom view of the gusset plate of FIG. 12;

FIG. 15 is an end elevational view of the gusset plate of FIG. 12; and

FIG. 16 is a sectional view taken along lines 16—16 of FIG. 14.

DESCRIPTION OF THE PREFERRED EMBODIMENT

Figure 1:
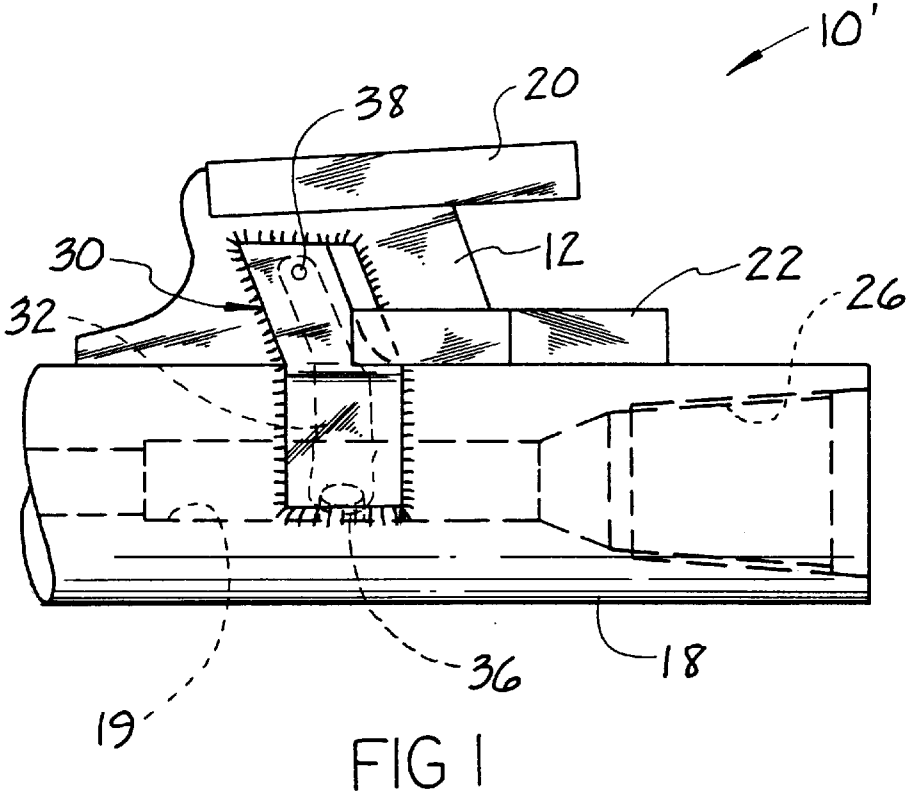
FIG. 1 is a side elevational view of a small diameter reamer with only one of the three wings shown.
Figure 4:
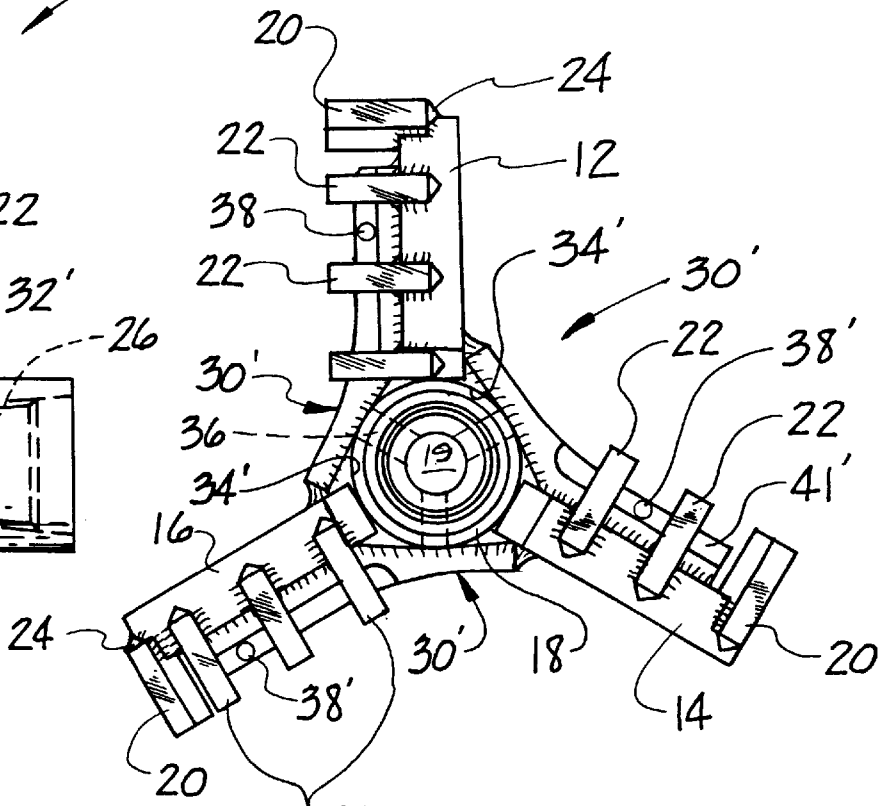
FIG. 4 is a front elevational view of the reamer shown in FIG. 3.
Figure 3:
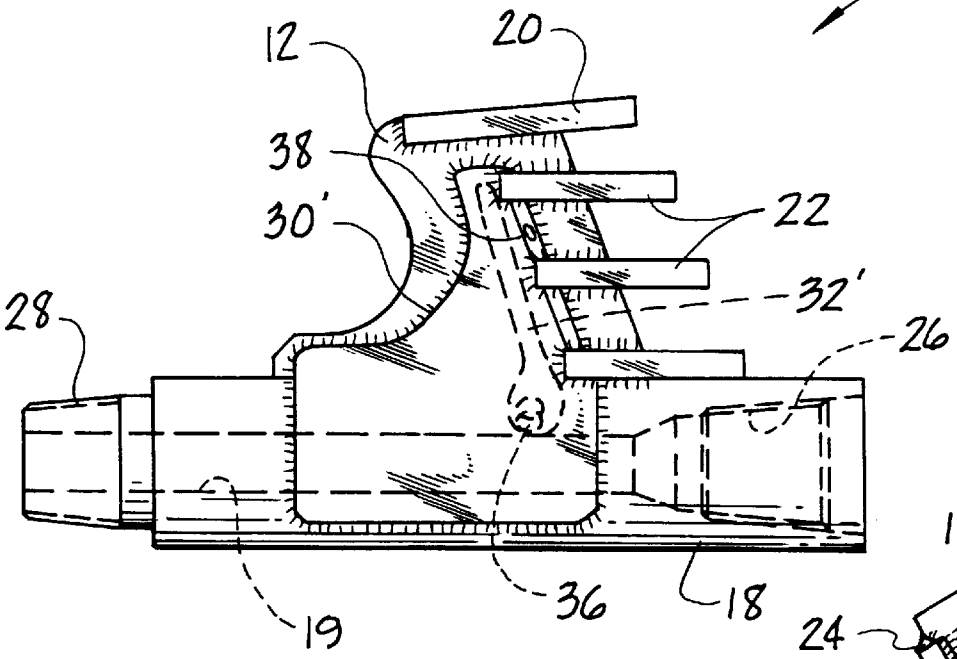
FIG. 3 is a side elevational view of a medium size reamer with only one wing shown.
Figure 5:
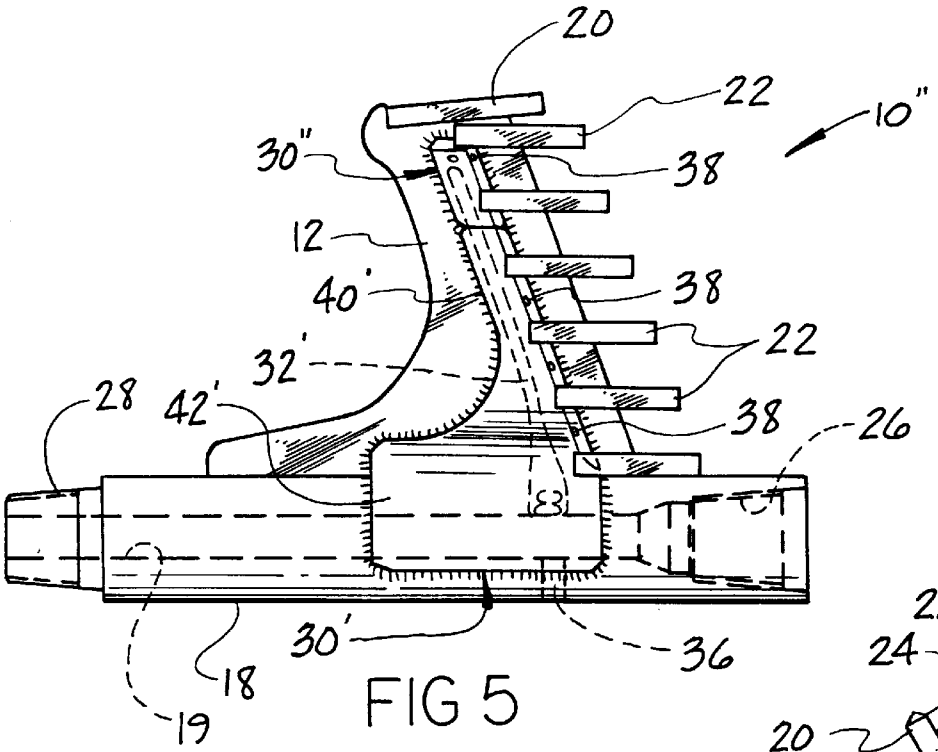
FIG. 5 is a side elevational view of a large diameter reamer with only one, wing shown.
Figure 11:
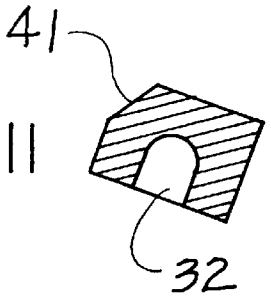
FIG. 11 is a sectional view taken along lines 11—11 of FIG. 9.

In the embodiments of the invention shown in the drawings, three different sizes of the backreamer of the present invention are shown, including the 6-inch reamer in FIG. 1, the 12-inch reamer in FIG. 3, and the 20-inch reamer in FIG. 5. The backreamer of the present invention is generally described by reference numeral 10, as shown in FIGS. 3 and 4. The backreamer includes an axle 18 having a center bore 19 therethrough with a female thread coupling 26 on the right end thereof for connection with the drill string for rotating the reamer, which drill string is not shown. On the left end of axle 18 is a tapered male coupling thread 28 as conventionally used in joints of drill pipe. Connected to male coupling 28 is any type of swivel, not shown, which in turn connects to the casing which is to be set in the bore or a utility line, also not shown, which is pulled back through the bore to the initial bore site. The purpose for the swivel is to allow the pulled in casing not to rotate as the backreamer rotates as it moves back through the pilot bore hole. Since the drill string for the pilot bore hole is threadably attached to the backreamer at coupling 26, the drilling rig has power not only to rotate the backreamer 10 but also to pull the drill string along with the backreamer back through the pilot bore.

The backreamer 10 includes three wings 12, 14 and 16 spaced at 120°, as best seen in FIG. 4, which are welded to axle 18 around their perimeter. Wings 12 and 16 include an outer cutter 20 along with three inner cutters 22 which are positioned at shorter radii inwardly on the wing.

Attached to the left side of wing 12, as seen in FIG. 4, is a gusset plate 30' which is shown in detail in FIGS. 12 through 16. Gusset plate 30' includes an arcuate surface 34' on its bottom side which is shaped to fit the outer diameter of axle 18 and is welded to axle 18 and wing 12 around its complete periphery, as seen in FIG. 3. On the back side of gusset plate 30' is a longitudinal passage 32 which connects with axle center bore 19 via bore 36 in axle 18. One or more jets 38 located along the angled surface 41 of the gusset plate are connected with longitudinal passage 32 so that drilling fluid which is pumped through center bore 19 from the drilling rig provides hydraulic cutting, lubrication, and the necessary removal of cuttings as the backreamer proceeds with its enlarged bore. From viewing FIG. 4, it can be readily seen that the gusset plates welded to the back side of the wings and the axle provide substantially more stiffness to the wings than the wings would have alone without them. This added strength allows the use of wings of lesser thickness and the gussets provide a secondary function of providing a fluid path for the jets 38 positioned outwardly at various radii on the wings.

Figure 6:
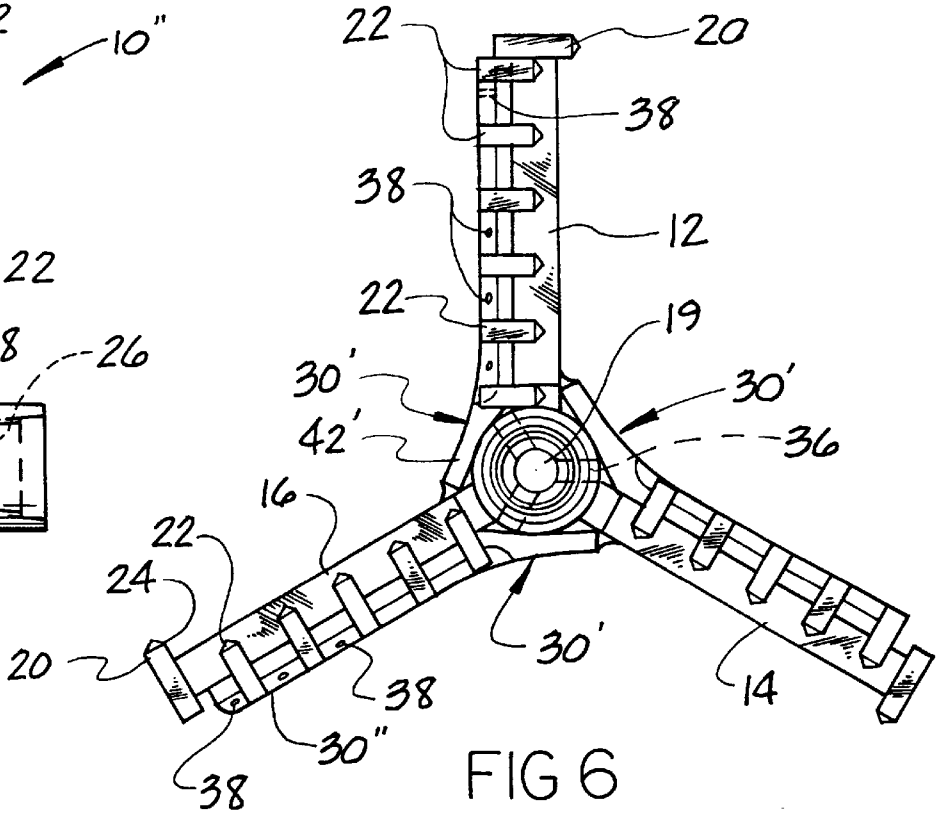
FIG. 6 is a front end elevational view of the reamer shown in FIG. 5 with a portion of one wing broken away.

In the large diameter back reamer 10", shown in FIG. 6, there are four jets 38 positioned at various radii outwardly from the axis of rotation of the tool to a distance just short of the outer cutter 20.

Figure 2:
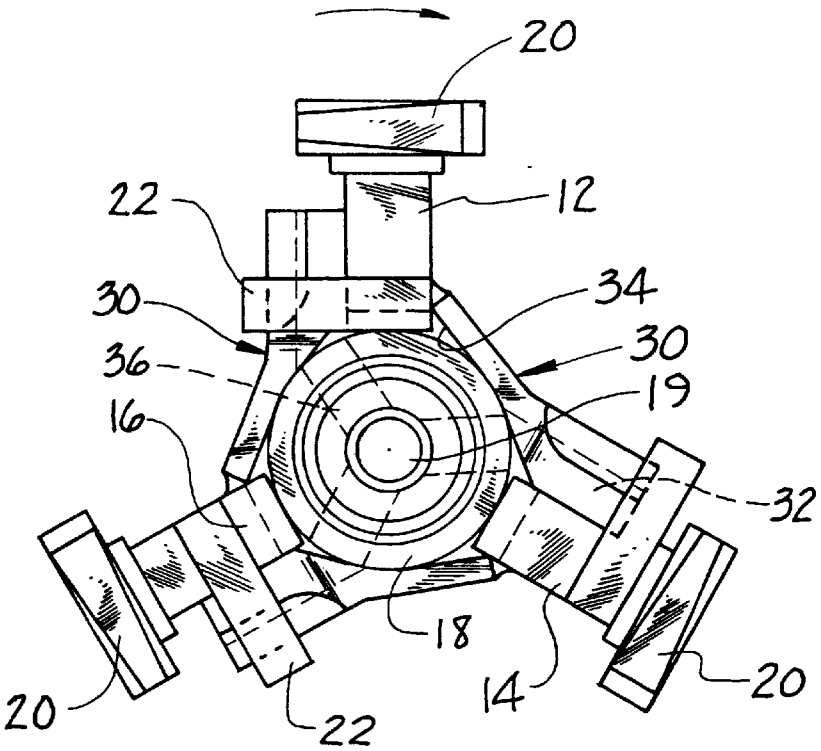
FIG. 2 is a front end elevational view of the reamer shown in FIG. 1.
Figure 9:
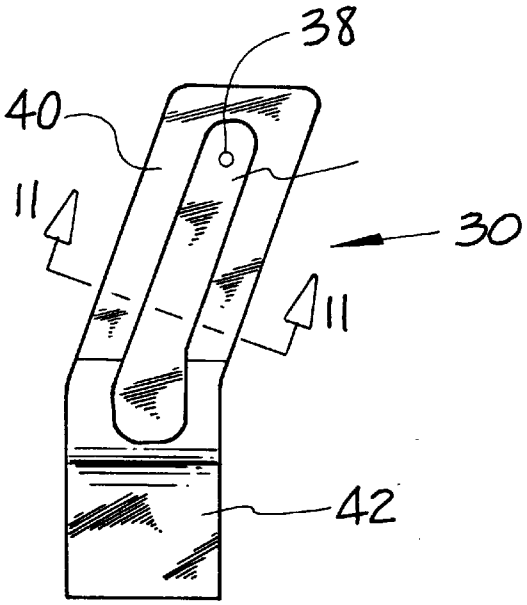
FIG. 9 is a bottom view of the gusset plate shown in FIG. 7.
Figure 8:
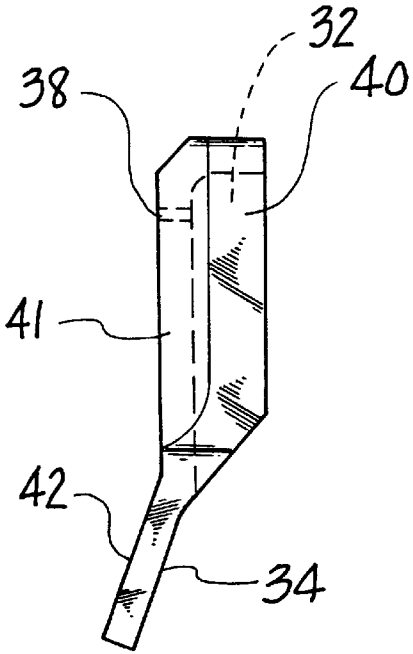
FIG. 8 is a right side elevational view of the gusset plate shown in FIG. 7.
Figure 10:
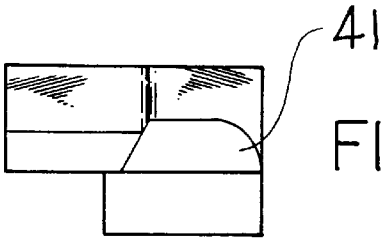
FIG. 10 is an end elevational view of the gusset plate shown in FIG. 7.
Figure 7:
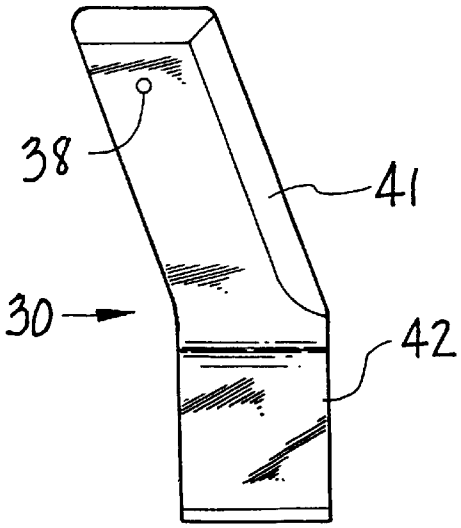
FIG. 7 is a plan view of the gusset plate shown in FIG. 1.

In FIG. 1, the backreamer 10' is of a smaller design with a 6-inch diameter and the gusset plate 30 is of a different shape, as shown in detail in FIGS. 7 through 11. Backreamer 10' rotates in a clockwise direction, as shown by the arrow in FIG. 2. In viewing FIGS. 1 and 2, gusset plate 30 includes a similar arcuate surface 34 which mates with the outer diameter of axle 18. The bottom side of gusset plate 30, as shown in FIG. 9, includes a longitudinal passage 32 which connects jet 38 with center bore 19 of the axle via bore 36 which is drilled radially in axle 18. Gusset plate 30 is welded around its periphery, as seen in FIG. 1, to the back side of wing 12 and axle 18 and the adjacent wing. Jets 38 can be placed either in the top surface of gusset plate, as shown in FIG. 7, or in the angled surface 41, as shown in FIGS. 3 and 5. The angle of the jet 38 in comparison to the axis of rotation of the reamer can be varied substantially, as demonstrated in FIGS. 1, 3 and 5.

FIG. 5, which is a 20-inch diameter reamer, includes a gusset plate fabricated of two parts—30' and 30". With the increased diameter of backreamer 10", the extending leg 40', as shown in FIG. 12, does not have sufficient length. In viewing FIG. 14, the tip of extending leg 40' is cut off so that longitudinal passage 32' is open at the end of extending leg 40'. Gusset plate 30, as shown in FIG. 7, is then taken and modified by cutting away the base portion 42 and then placing the remaining portion of extending leg 40 adjacent the end of the previously cut-off gusset plate 30', as shown in FIG. 5. With these two modified portions of the two separate gusset plates placed end to end and welded in place, the end result is a gusset plate with a slightly longer length due to the extension provided by cut-off portion 30". This permits the use of two castings to provide reamers of at least six different sizes.

Accordingly, while the preferred embodiments of the invention have been described above, it will be recognized and understood that various modifications max be made in the invention and the appended claims are intended to cover all such modifications which may fall within the spirit and scope of the invention.

Having described my invention with the particularities set forth above, what is claimed is:

1. A directional drilling rotatable backreamer for enlarging an initial bore comprising:

an axle with a longitudinal bore therethrough terminating in threaded fittings at each end thereof;

a plurality of wings attached to said axle spaced around the axle and extending radially outward from the axle;

a plurality of cutters attached to each of said wings for enlarging the initial bore;

a plurality of gusset plates, each gusset plate being welded to the axle and a wing for added bending strength to the wing.

2. A directional drilling backreamer, as set forth in claim 1, wherein the gusset plate includes a fluid jet in the gusset plate and an internal passage way connecting the fluid jet to the longitudinal bore in the axle.

3. A directional drilling backreamer, as set forth in claim 1, wherein each gusset plate is positioned on the back side of a wing and loaded in compression and each gusset plate includes a base portion having an arcuate surface which mates with said axle and is welded thereto.

4. A directional drilling backreamer, as set forth in claim 2, wherein said gusset plates include an extension portion having an internal passageway connectable to the internal passage way of said gusset plate for extending the fluid jets further outwardly on the wings.

5. A directional drilling backreamer, as set forth in claim 1, wherein the gusset plates include an internal passageway connected to the longitudinal bore in the axle, a fluid jet in said gusset plate connected to said internal passage way, the gusset plate further including a base portion having an arcuate surface which mates with said axle and is welded around its periphery to the axle, said wing, and adjacent wing.

6. A directional drilling backreamer, as set forth in claim 1, wherein the gusset plate includes an enlarged base portion having an arcuate surface which mates with and is welded to said axle, the gusset plate also including an extending leg portion of reduced cross section which is welded to said wing.

7. A directional drilling backreamer, as set forth in claim 1, where each of the wings lies in a plane which includes the axis of rotation of the backreamer.

8. A directional rotatable backreamer for enlarging an initial bore comprising:

an axle with a longitudinal bore therethrough terminating in threaded fittings at each end thereof;

a plurality of wings attached to said axle spaced around the axle and extending radially outward from the axle;

a plurality of cutters attached to each of said wings for enlarging the initial bore;

a plurality of gusset plates, each gusset plate being welded to the axle at the juncture of the wing and axle and to the wing for added bending strength to the wing.

* * * * *